US006891323B2

(12) United States Patent
Lima et al.

(10) Patent No.: US 6,891,323 B2
(45) Date of Patent: May 10, 2005

(54) FLUORESCENT LAMP AND AMALGAM ASSEMBLY THEREFOR

(75) Inventors: Joseph V. Lima, Salem, MA (US); Richard S. Speer, Concord, MA (US)

(73) Assignee: Osram Sylvania Inc., Danvers, MA (US)

( * ) Notice: Subject to any disclaimer, the term of this patent is extended or adjusted under 35 U.S.C. 154(b) by 98 days.

(21) Appl. No.: 10/247,891

(22) Filed: Sep. 20, 2002

(65) Prior Publication Data

US 2004/0056583 A1 Mar. 25, 2004

(51) Int. Cl.[7] ..... H01J 1/62; H01J 17/22; H01J 61/26; H01J 17/49

(52) U.S. Cl. ..... 313/490; 313/491; 313/492; 313/493; 313/546; 313/561; 313/582

(58) Field of Search ..... 313/546, 561, 313/490–493, 558, 559, 564–566, 160, 161, 153, 545, 635, 550, 607, 594; 220/2.2; 445/21, 22; 427/66–67; 315/267, 248

(56) References Cited

U.S. PATENT DOCUMENTS

| | | | | | |
|---|---|---|---|---|---|
| 4,035,682 | A | | 7/1977 | Bubar | 313/174 |
| 4,393,325 | A | | 7/1983 | van der Kooi | 313/552 |
| 4,528,209 | A | | 7/1985 | Anderson et al. | 427/67 |
| 5,434,482 | A | | 7/1995 | Borowiec et al. | 315/248 |
| 5,629,584 | A | * | 5/1997 | Borowiec et al. | 313/565 |
| 5,767,617 | A | | 6/1998 | Wharmby et al. | 313/489 |
| 5,994,837 | A | | 11/1999 | Willems et al. | 313/550 |
| 6,097,137 | A | * | 8/2000 | Forsdyke et al. | 313/161 |
| 6,650,041 | B1 | * | 11/2003 | Speer et al. | 313/490 |
| 6,653,775 | B1 | * | 11/2003 | Speer et al. | 313/490 |

* cited by examiner

*Primary Examiner*—Joseph Williams
*Assistant Examiner*—Matt Hodges
(74) *Attorney, Agent, or Firm*—Carlo Bessone

(57) ABSTRACT

An amalgam assembly for a fluorescent lamp includes an exhaust tubulation closed at a free end thereof, a glass ball disposed in the tubulation, and a mercury amalgam body disposed in the tubulation between the glass ball and the tubulation closed end. The tubulation is provided with a pinched portion comprising a plurality of inwardly extending dimples separated from each other and adapted to engage the glass ball to retain the glass ball on a central axis of the tubulation. The glass ball rests on the dimples concentrically and gaps between the dimples allow gas to pass therethrough between the glass ball and an inside surface of the tubulation.

9 Claims, 2 Drawing Sheets

FLUORESCENT LAMP AND AMALGAM ASSEMBLY THEREFOR

BACKGROUND OF THE INVENTION

1. Field of the Invention

This invention relates to fluorescent lamps and is directed more particularly to an amalgam assembly including an improved exhaust tubulation, and to a fluorescent lamp including the improved exhaust tubulation.

2. Description of the Prior Art

The light output of fluorescent lamps is critically dependent upon mercury vapor pressure (vapor density) within the lamp envelope. The mercury vapor pressure, in turn, is controlled by the temperature of excess liquid mercury which condenses in the coldest part of the lamp envelope, the so-called "cold spot". Fluorescent lamps typically include at least one tubulation that has an opening into the interior of the lamp envelope and which, in construction of the lamp, is used as an exhaust tubulation. At completion of manufacture, the exhaust tubulation is hermetically tipped off and the tipped end typically becomes the lamp "cold spot".

The amalgam is commonly located in the exhaust tubulation cold spot. Such amalgams reduce the mercury vapor pressure relative to that of pure mercury at any given temperature and thereby permit optimum light output at elevated temperatures. Such amalgams also provide a broadened peak in the light output versus temperature curve, so that near optimum light output is obtained over an extended range of ambient temperatures.

When lamps are operated at temperatures lower or higher than the optimum ambient temperature, light output decreases by as much as 30% or more relative to peak value. This is a common occurrence when lamps are operated in enclosed or semi-enclosed fixtures. In addition to reduced light output, the color of the light varies as a result of the varying contribution of blue spectral emission from the mercury vapor in the discharge.

The problem of mercury vapor pressure control under varying temperature conditions is solved, at least in part, through the use of various alloys capable of absorbing mercury from its gaseous phase. Alloys of low temperature melting metals are often placed within fluorescent lamps to amalgamate with excess mercury, and to regulate the mercury vapor pressure within the lamp. Alloys known to be particularly useful in forming amalgams with mercury include a lead-bismuth-tin alloy, a bismuth-indium alloy, a bismuth and tin alloy, and a zinc, indium and tin alloy. Other useful amalgams are formed with pure indium, pure lead, and pure zinc.

The lamp typically is provided with an excess amount of mercury amalgam, that is, more amalgam than is needed to supply the mercury vaporized when the lamp reaches a stabilized operating condition. As the lamp ages, some of the excess amalgam is required to replace the mercury chemically bound elsewhere in the lamp during the life of the lamp.

When an amalgam fluorescent lamp is turned off, the amalgam cools and the mercury vapor within the lamp is gradually absorbed into the amalgam. When the lamp is turned on, the lumen output is significantly reduced until the amalgam is warmed up to a point at which the amalgam emits sufficient mercury vapor to permit efficient lamp operation.

In some types of lamps, particularly electrodeless fluorescent lamps, it is important that the amalgam be prevented from settling within the arc environment in the lamp envelope where the amalgam can cause deleterious changes in the lumen output and the lumen-temperature performance of the lamp, causing a sudden rise in mercury vapor pressure and an increase in lamp voltage, resulting in the occurrence of black spots on the glass envelope. If the lamp voltage exceeds the maximum sustaining voltage of the ballast provided in the lamp, the lamp extinguishes. There is thus required a means for retaining liquid amalgam in the tubulation, but permitting mercury vapor to exit the tubulation and flow into the lamp envelope.

Typically, the exhaust tubulation is pinched inwardly during manufacture of the lamp. At least one glass ball is then placed in the tubulation through an open end of the tube and comes to rest on the pinched portion of the tubulation. An amalgam body is then inserted into the tubulation and comes to rest adjacent the uppermost glass ball. Near the end of the manufacturing process, the lamp envelope is evacuated through the exhaust tubulation. The evacuation of the lamp envelope is sometimes blocked or hampered by the presence of the glass ball at the pinched portion of the tubulation. In time, the glass ball is forced from the tubulation pinched portion sufficiently to allow gas to pass and the lamp to be evacuated. The aforementioned open end of the tube is then sealed, with the amalgam disposed between the newly sealed tubulation end and the glass ball or balls adjacent the tubulation pinched portion.

While the glass balls in due course give way under the pressure of exiting gas and permit evacuation of the lamp envelope and tubulation, it is deemed desirable to provide a tubulation and glass ball arrangement which permits ready evacuation through the tubulation, while retaining the glass ball or balls.

The glass balls serve the function of keeping the solid amalgam spaced from the tubulation pinched portion and, after the amalgam is liquidized in operation of the lamp, to prevent the amalgam from passing therethrough to the aforementioned lamp envelope arc environment, while permitting mercury vapor to pass therethrough. There is a need, then, that the glass ball retention means, that is, the tubulation pinched portion be such as to facilitate the passage of mercury vapor around the glass balls to and from the amalgam.

SUMMARY OF THE INVENTION

An object of the invention is, therefore, to provide an amalgam assembly including an improved exhaust tubulation which facilitates outflow of gas during manufacture and which facilitates flow of mercury vapor therethrough during operation of the lamp.

A further object of the invention is to provide a fluorescent lamp including the improved amalgam assembly.

With the above and other objects in view, as will hereinafter appear, a feature of the present invention is the provision of an amalgam assembly for a fluorescent lamp. The assembly includes a glass exhaust tubulation closed at a free end thereof, a glass ball disposed in the tubulation, and a mercury amalgam body disposed in the tubulation between the glass ball and the tubulation closed end. The tubulation is provided with a pinched portion comprising a plurality of inwardly extending dimples separated from each other and adapted to engage the glass ball to retain the glass ball on a central axis of the tubulation. A lowermost of the glass balls rests on the dimples concentrically within the tubulation, and gaps between dimples allow gas to pass therethrough and between the lowermost glass ball and an inside surface of the tubulation.

In accordance with a further feature of the invention, there is provided an electrodeless fluorescent lamp including a light-transmissive envelope containing an ionizable, gaseous fill for sustaining an arc discharge when subjected to a radio frequency magnetic field and for emitting ultraviolet radiation as a result thereof, the envelope having an interior phosphor coating for emitting visible radiation when excited by the ultraviolet radiation, the envelope having a re-entrant cavity formed therein. An excitation coil is contained within the re-entrant cavity for providing the radio frequency magnetic field when excited by a radio frequency power supply. An exhaust tubulation extends through the re-entrant cavity and into the envelope for evacuating the lamp, the exhaust tubulation having a closed end proximate a base portion of the lamp. A glass ball is disposed in the tubulation and a mercury amalgam body is disposed in the tubulation between the glass ball and the tubulation closed end. A tubulation pinched portion includes a plurality of inwardly extending dimples separated from each other and adapted to engage the glass ball to retain the glass ball on a central axis of the tubulation. When the glass ball rests on the dimples concentrically within the tabulation, gaps between the dimples allow gas to pass therethrough between the glass ball and an inside surface of the tubulation.

The above and other features of the invention, including various novel details of construction and combinations of parts, will now be more particularly described with reference to the accompanying drawings and pointed out in the claims. It will be understood that the particular devices embodying the invention are shown and described by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
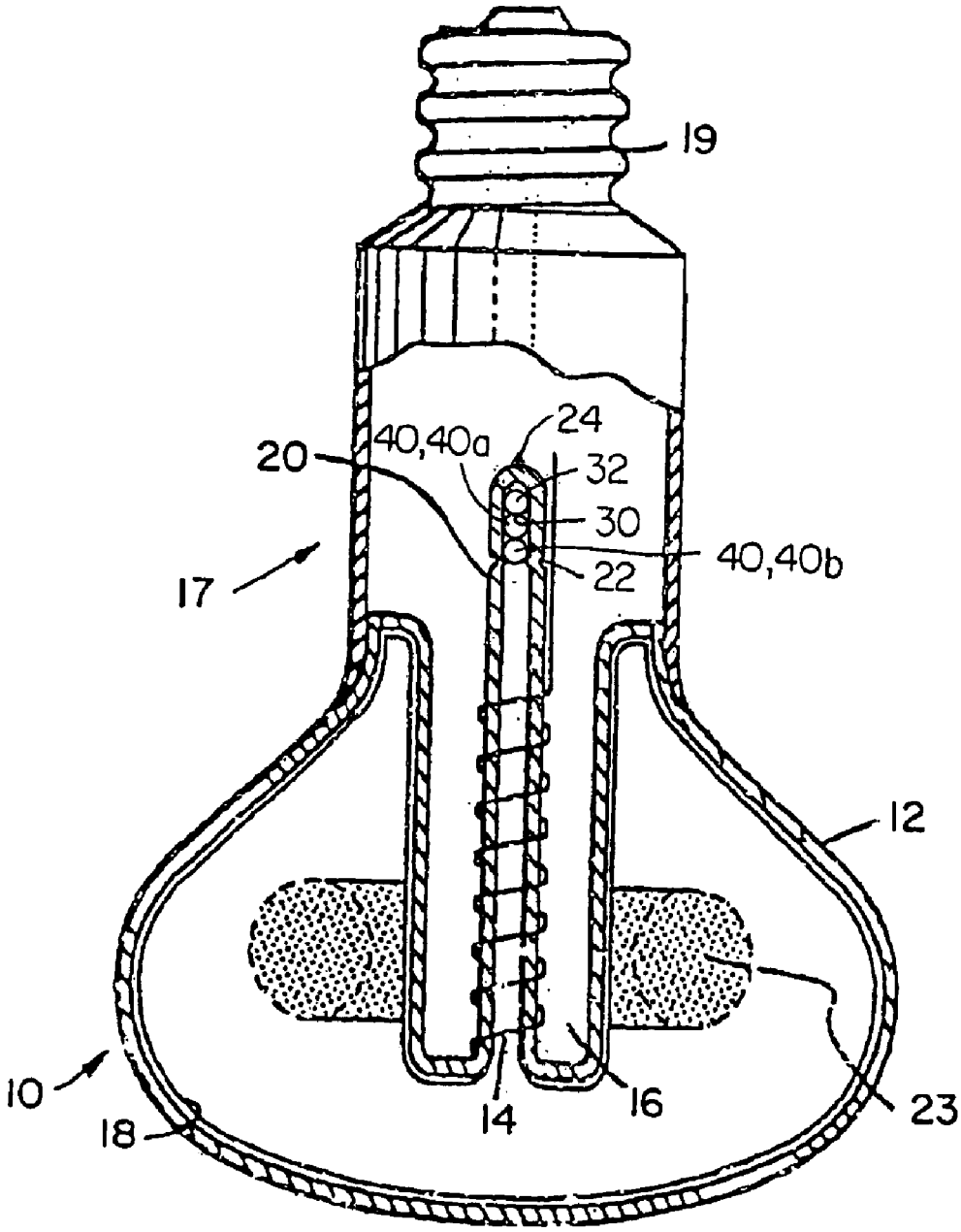
FIG. 1 PRIOR ART
FIG. 1 is an elevational broken-away and partly sectional view of a prior art electrodeless fluorescent lamp.

Referring to FIG. 1, it will be seen that a known compact fluorescent lamp 10 is provided with a light-transmissive envelope 12 containing an ionizable gaseous fill for sustaining an arc discharge. In manufacture, the lamp 10 is dosed with the fill via an exhaust tubulation 20 in a known manner. A suitable fill, for example, comprises a mixture of a rare gas (e.g., krypton and/or argon) and mercury vapor. An excitation coil 14 is situated within, and removable from, a re-entrant cavity 16 within the envelope 12. For purposes of illustration, the coil 14 is shown schematically as being wound about the exhaust tubulation 20. However, the coil 14 may be spaced apart from the exhaust tubulation 20 and wound about a core of insulating material (not shown), or may be free standing (not shown), as desired. The interior surfaces of the envelope 12 are coated in well-known manner with a suitable phosphor 18. The envelope 12 fits into one end of a base assembly 17 containing a radio frequency power supply (not shown) with a standard (e.g., Edison type) lamp base 19.

A mercury amalgam body 32 is placed and retained in a location optimized for the particular amalgam in a particular lamp. Each amalgam has its own optimum range of operating temperatures to provide a suitable mercury vapor pressure.

An indentation, or pinched portion 22, is situated toward a tip-off region of the exhaust tubulation 20. The tip-off region is the area at the free end of the exhaust tubulation which is sealed, or "tipped off" to form the closed end 24 of the exhaust tubulation after evacuating the lamp therethrough.

After the lamp is evacuated through the exhaust tubulation 20, an appropriately sized and shaped dose locating member 40, preferably comprising at least one glass ball, is inserted into the exhaust tubulation 20 through the opening at the tip-off region. By virtue of the presence of the pinched portion 22 and the size and shape of dose locating member 40, the dose locating member remains on the side of the dimple away from re-entrant cavity 16. The amalgam 32 is then inserted into the exhaust tubulation 20 through the opening in the tip-off region. The combination of pinched portion 22 and the dose locating member 40 results in placement of the amalgam 32 at a predetermined location. Finally, as noted above, the exhaust tubulation 20 is tipped-off at a location adjacent the amalgam 32 to form the tubulation closed end 24.

In operation, current flows in the coil 14 as a result of excitation by the radio frequency power supply. A radio frequency magnetic field is thereby established within the envelope 12 which ionizes and excites the gaseous fill contained therein, resulting in a toroidal discharge 23 and emitting ultraviolet radiation therefrom. The phosphor 18 absorbs the ultraviolet radiation and emits visible radiation.

Figure 2:
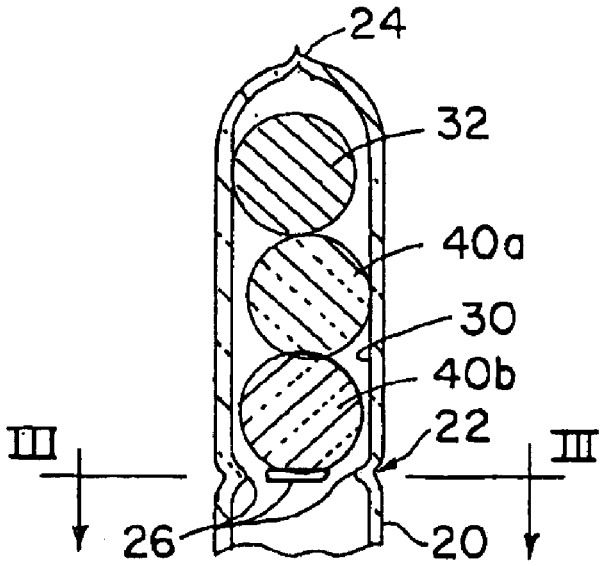
FIG. 2 is a diagrammatic sectional illustration of an improved amalgam assembly for the lamp of FIG. 1.

Referring to FIG. 2, it will be seen that in accordance with the present invention there is provided an amalgam assembly including the glass ball or balls 40*a*, 40*b* disposed in the glass tubulation 20 and retained by the pinched portion 22 of the tubulation.

Figure 3:
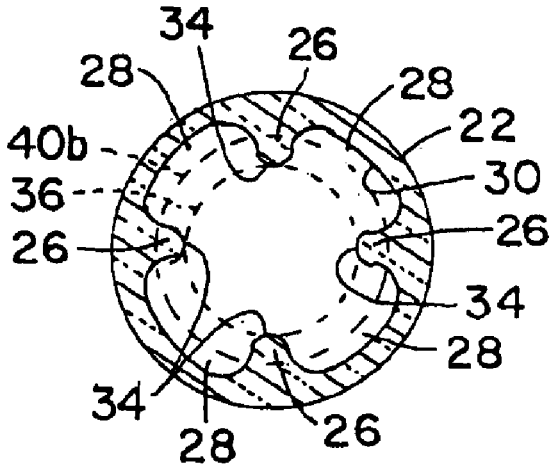
FIG. 3 is a sectional view taken along line III—III of FIG. 2.

Referring to FIG. 3, it will be seen that the tubulation pinched portion 22 includes a plurality of dimples 26 extending radially inwardly of the tubulation 20, the dimples 26 being separated from each other to form gaps 28 therebetween.

The lowermost 40*b* of the glass balls is adapted to rest on the dimples 26 concentrically within the tubulation. The gaps 28 between the dimples permit gas to flow therethrough, between the outer surface of the glass ball 40*b* and an interior surface 30 of the tubulation 20.

The dimples 26 are of equal length along their radial extension and are adapted to engage the glass ball 40*b* so as to permit the glass ball 40*b* to rest on the central axis of the tubulation, that is, concentrically of the tubulation.

The glass ball 40*b* is of a spherical shape and is provided with a diameter exceeding an inner diameter of a hypothetical circle 36 defined by dimple inner extending end portions 34, and less than an inner diameter of the tubulation inside surface 30.

The pinched portion 22 may include one or two sets of opposed dimples 26 (two sets shown in FIG. 3), or three or more dimples, so long as the combination of dimples centers the glass ball 40*b* thereon, while leaving the gaps 28 between the dimples, as well as between the glass ball outer surface and the tubulation inner surface.

There is thus provided an amalgam assembly having facility for retaining a dose locating glass ball in such a disposition within the exhaust tubulation as to permit the evacuation of the lamp body near the end of lamp manufacture, and permit mercury vapor flow therearound during operation of the lamp.

The invention further contemplates the provision of an electrodless fluorescent lamp, as shown in FIG. 1 and described above, but with the feature of FIGS. 2 and 3 incorporated therein.

It will be understood that many additional changes in the details, materials, and arrangement of parts, which have been herein described and illustrated in order to explain the nature of the invention, may be made by those skilled in the art within the principles and scope of the invention.

What is claimed is:

1. An amalgam assembly for a fluorescent lamp, the assembly comprising:

a glass exhaust tubulation closed at a free end thereof;

a glass ball disposed in said tubulation;

a mercury amalgam body disposed in said tubulation between said glass ball and the tubulation closed end; and a tubulation pinched portion comprising three or more concentrically located inwardly extending dimples separated from each other and adapted to engage said glass ball to retain said glass ball on a central axis of the tubulation;

whereby when said glass ball rests on the dimples concentrically within the tubulation, gaps between the dimples allow gas to pass therethrough between said glass ball and an inside surface of said tubulation.

2. The amalgam assembly in accordance with claim 1 wherein said glass ball is spherically shaped and is provided with a diameter exceeding an inner diameter of a hypothetical circle defined by inner extending end portions of the dimples, and less than an inner diameter of said tubulation.

3. The amalgam assembly in accordance with claim 2 wherein the plurality of dimples includes opposed dimples.

4. The amalgam assembly in accordance with claim 3 wherein the plurality of dimples includes two sets of the opposed dimples.

5. The amalgam assembly in accordance with claim 1 wherein said amalgam body comprises an alloy composition selected from a group of alloy compositions consisting of (i) lead and bismuth and tin, (ii) bismuth and indium, (iii) bismuth and tin, (iv) zinc and indium and tin, (v) indium alloys, (vi) lead alloys, and (vii) zinc alloys.

6. The amalgam assembly in accordance with claim 5 wherein said amalgam body is spherically shaped when in a solid state.

7. An electrodeless fluorescent lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by the ultraviolet radiation, said envelope having a re-entrant cavity formed therein;

an excitation coil contained within the re-entrant cavity for providing the radio frequency magnetic field when excited by a radio frequency power supply;

an exhaust tubulation extending through the re-entrant cavity and into said envelope for evacuating said lamp, said exhaust tubulation having a closed end proximate a base portion of the lamp;

a glass ball disposed in said tubulation;

a mercury amalgam body disposed in said tubulation between said glass ball and the tubulation closed end; and a tubulation pinched portion comprising of three or more concentrically located inwardly extending dimples separated from each other and adapted to engage said glass ball to retain said glass ball on a central axis of the tubulation;

whereby when said glass ball rests on the dimples concentrically within the tubulation, gaps between the dimples allow gas to pass therethrough between said glass ball and an inside surface of said tubulation.

8. The amalgam assembly in accordance with claim 7 wherein the opposed dimples.

9. The amalgam assembly in accordance with claim 8 wherein the plurality of dimples includes two sets of the opposed dimples.

* * * * *